United States Patent [19]

Schmidt

[11] 4,053,705

[45] Oct. 11, 1977

[54] TERMINAL CAP

[75] Inventor: Bradley J. Schmidt, East Dundee, Ill.

[73] Assignee: Illinois Tool Works Inc., Chicago, Ill.

[21] Appl. No.: 731,070

[22] Filed: Oct. 8, 1976

[51] Int. Cl.[2] ..... H01R 5/12; H01R 13/44

[52] U.S. Cl. ..... 174/138 F; 339/113 B; 339/198 J

[58] Field of Search ..... 174/74 A, 87, 138 F; 339/36, 97 R, 97 P, 97 T, 98, 99 R, 113 R, 113 B, 113 L, 116 R, 116 C, 147 P, 149 P, 150 B, 151 B, 198 R, 198 J, 213 R, 213 T

[56] References Cited

U.S. PATENT DOCUMENTS

| | | | |
|---|---|---|---|
| 1,564,321 | 12/1925 | Cameron | 339/36 X |
| 2,369,735 | 2/1945 | Heit | 174/74 A X |
| 2,715,714 | 8/1955 | Pavlinetz | 339/213 R |
| 3,778,753 | 12/1973 | Occhipinti et al. | 339/151 B X |

FOREIGN PATENT DOCUMENTS

| | | | |
|---|---|---|---|
| 554,619 | 3/1923 | France | 174/87 |
| 993,178 | 7/1951 | France | 339/97 R |
| 860,473 | 2/1961 | United Kingdom | 174/87 |
| 1,127,437 | 9/1968 | United Kingdom | 339/147 P |

OTHER PUBLICATIONS

Owen, M. P., "Safety Cover," *IBM Technical Disclosure Bulletin*, vol. 15, No. 7, Dec. 1972, p. 2048 & 2049.

*Primary Examiner*—Laramie E. Askin

*Attorney, Agent, or Firm*—Jack R. Halvorsen; Robert W. Beart

[57] ABSTRACT

A one-piece dielectric terminal cap having a generally rectangular tapered bore with a wide mouth opening for accepting a distorted two prong edge-to-edge terminal and restoring it substantially to its initial position. The cap also includes means for probe testing the terminal without removal of the cap from the terminal, plus tool engaging means.

5 Claims, 8 Drawing Figures

TERMINAL CAP

BACKGROUND OF THE INVENTION

In the communications field it is common to connect practice internal station wiring to the external sources of information by means of a terminal wiring block. These blocks, which are well known in the art, generally include a dielectric base having two or more terminals interconnected in a single row and with each block being provided with a multiplicity of rows of terminals. The terminals generally include a pair of finger-like elements disposed in edge-to-edge relationship with the insulated conductors being fed between adjacent edges of the terminals. Such feeding slices the insulation causing a contact to be made between the terminal and the conductor within the insulation. After extended useage of a particular terminal, it has been found that the blade-like finger elements become angularly disposed in two planes perpendicular to one another with the spacing between the edges "opening up" and thereby providing a poor contact with the conductor that has been forced between the edges. This results in noise in the circuit causing a poor transmission or connection between the parties using the circuit.

BRIEF SUMMARY OF THE INVENTION

This invention relates to a one-piece dielectric terminal cap having a generally rectangular tapered bore provided with a wide mouth opening for accepting a distorted two prong edge-to- edge terminal and restoring the terminal substantially to its initial position. The tapered bore terminates at the end opposite the wide mouth in a substantially rectangular bore having a cross-sectional configuration equal to or slightly greater than the initial configuration of the terminal before it is distorted by a wire being introduced between its edges.

Means are provided in such a terminal cap for probe testing the circuit serviced by the terminal removal of the cap from the terminal.

A further feature of the present invention is tool engaging means which permit the cap to be positioned on the terminal. Such tool engaging means accommodates the size of the tool with relation to adjacent terminal caps used on adjacent rows of terminals.

An additional feature of the present invention is the provision of indicia means in the form of color in such caps to readily identify a particular circuit passing through a row of terminals located in a wiring board.

Still another object of the present invention is to provide an economical dielectric cap which overcomes the deficiencies of distorted terminals and restores them to useable condition without having to remove an entire terminal board from its mounted position with the incident rewiring of such board.

Other objects will be apparent to those skilled in the art when the specification is read in conjunction with the accompanying drawing.

DETAILED DESCRIPTION OF THE INVENTION

Figure 1:
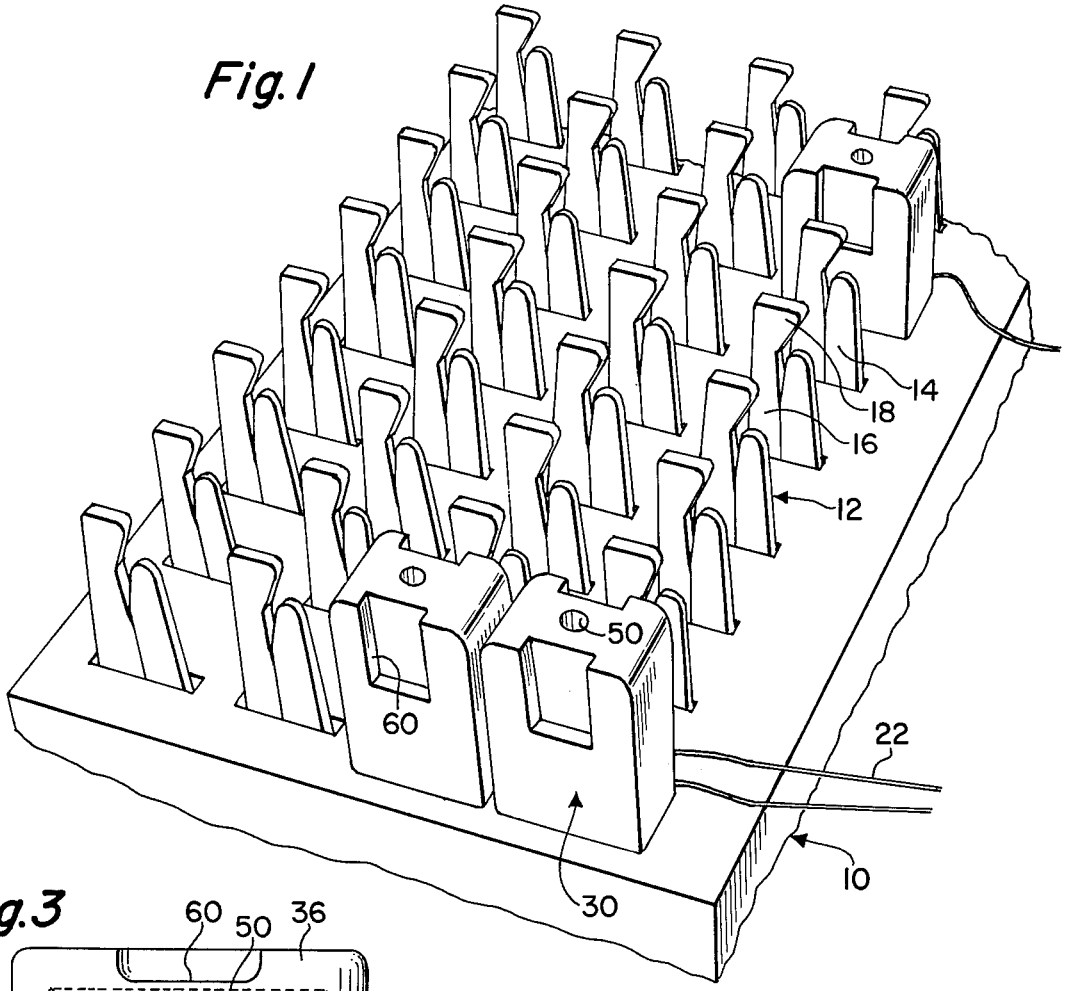
FIG. 1 is a perspective view in partial section of a plurality of rows of terminals on a terminal board showing the environment in which the present invention is utilized.

Referring now to the drawing wherein similar parts are designated by similar numerals; the perspective view in FIG. 1 shows a terminal block 10 in partial section. Such a terminal block 10 normally is provided with pairs of terminals arranged in transverse rows. At least two of the adjacent terminals are interconnected below the upper surface of the block 10 and in some instances the entire transverse row of terminals is interconnected. Such blocks 10 with their terminals 12 are well known in the art and to those skilled in the art they will recognize the fact that there generally is provided a side wall having a plurality of slots generally aligned with each transverse row for orienting and distributing the wires incident thereto. For clarity of illustration, the side walls and slots have been eliminated from FIG. 1.

Figure 5:
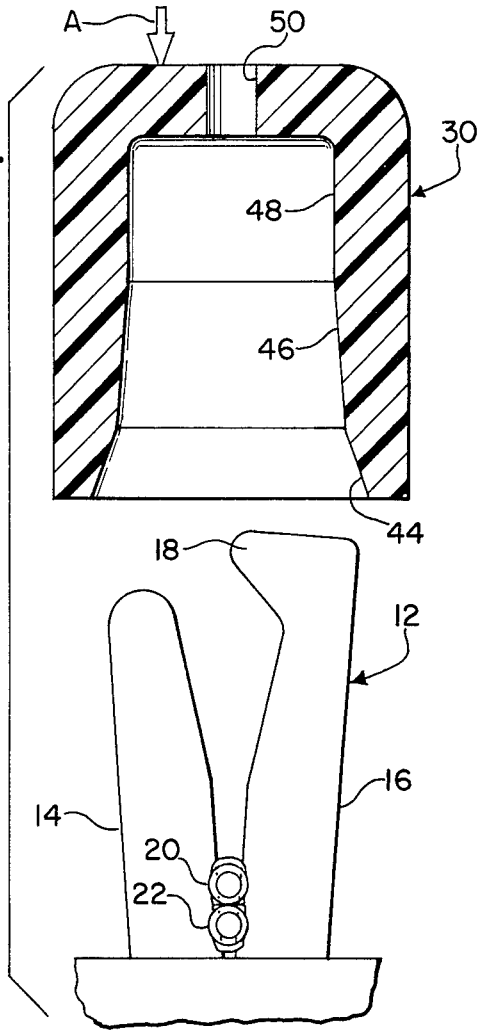
FIG. 5 is an expanded view in partial section showing the distortion of a terminal in one plane by the introduction of wires between the edges of the terminal.
Figure 6:
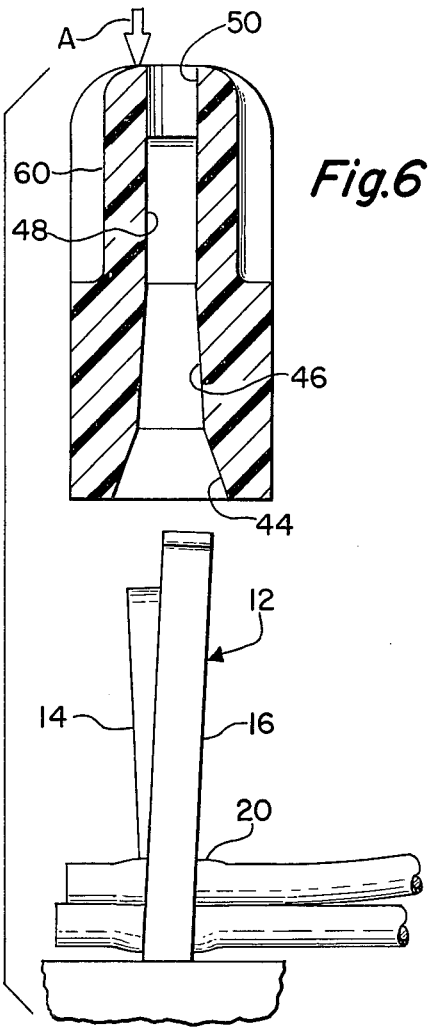
FIG. 6 is an expanded side view in partial section of a single terminal showing its angular distortion in a second plane perpendicular to that shown in FIG. 5 caused by insertion of wires between the edges of the terminal.

As is well known in the art, such terminals include a pair of edge-to-edge blade-like fingers with one finger 14 having a curved upper end; while the second finger 16 has an enlarged upper end 18 which overhangs the slot between the edges of the fingers. This generally forms a mouth for feeding in an unstripped, small diameter wire of the type generally used in telephonic communications. As the wire is forced between the edges of the terminal, the fingers, as can be best seen in FIG. 5 and FIG. 6, more laterally away from one another and also are moved angularly out of their initial common plane. This is caused by the general removal of the mass of insulation 20 to provide contact with the conductor 22. After prolonged useage of a particular terminal, it will be appreciated that there is a tendency for it to become distorted and to not provide the necessary contact between the terminal and the wire. This results in a bad "connection", static and noise on the circuit and thereby affects the effective use of the circuit by the ultimate user. Heretofore, when a terminal was so affected by multiplicity of use, due to frequent changes in internal station changes, it became necessary to either change the particular row that was used for such a circuit or, in some instances, to replace the entire terminal wiring block. It will be appreciated that making such changes requires a high degree of labor input resulting in a high cost to the telephonic industry who make extensive useage of such blocks.

Figure 3:
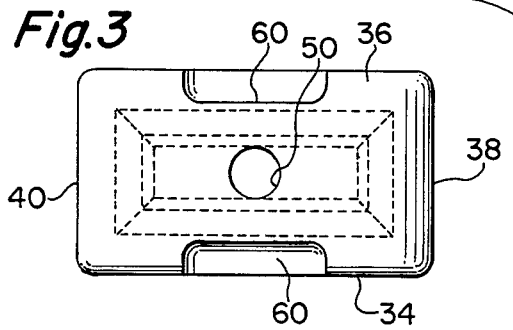
FIG. 3 is a top end view of the embodiment shown in FIG. 2.
Figure 2:
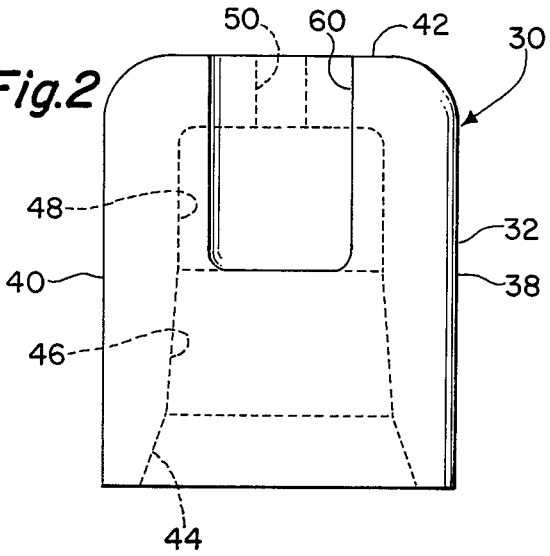
FIG. 2 is an elevational view of an embodiment of the present invention.
Figure 4:
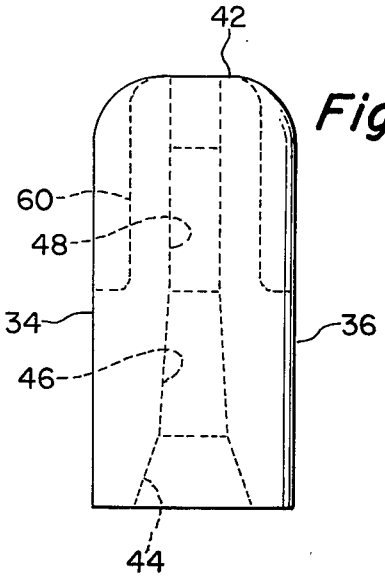
FIG. 4 is a side elevational view of the embodiment shown in FIG. 2.

The present invention relates to a one-piece dielectric cap 30 which substantially overcomes the necessity for replacement or rewiring of terminal blocks where the terminals have been distorted through a multiplicity of uses. Such a cap 30 includes a one-piece thermoplastic, dielectric elongated body 32 having a generally rectangular cross section. The body 32 includes a front and back wall 34 and 36; side walls 38 and 40; and an end wall 42. Opening through the bottom end of the cap 30, as viewed in the drawings, is a tapered bore having a first portion 44 forming a wide mouth for accepting a distorted terminal. It will be noted in FIGS. 2 through 4 that the bore is tapered in the two planes falling on the axis of the cap to accommodate and correct the double angular distortion illustrated in FIGS. 5 and 6. The mouth or throat portion 44 blends into a second pyramidal portion 46 having a lesser included angle in its taper and terminates in a substantially straight rectangular bore 48 having a predetermined cross-sectional configuration which is generally equal to or just slightly greater than the initial cross-sectional configuration of the upper end of the terminal 12. The portion 48 of the bore is terminated by the end wall 42 which includes a central aperture 50 that communicates through end wall 42 with the upper end portion 48 of the bore.

As best seen in FIGS. 5 through 8, a cap 30 is axially moved downwardly, in the direction of the arrow "A", to encircle and restore the terminal 12 to substantially its initial configuration. The double taper of the bore slowly, without undue stress, moves the distorted ends of the fingers 14 and 16 back into generally parallel relationship. It will be seen in FIG. 7 that the cross-sectional configuration of the upper portion 48 of the bore is equal to or slightly greater than the intial edge-to-edge configuration of the terminal fingers 14 and 16. In most instances these fingers 14 and 16 are initially touching through a substantial portion of their extent, other than for the feed-in throat, but will be distorted laterally to accommodate the thickness of the conductor 22 with the insulation 20 bulging outwardly on opposite sides of the fingers 14 and 16.

Since adjacent transverse rows of terminals are closely positioned, to conserve space, it is preferable to provide tool engaging means such as the slots 60 which in the present instance are axially disposed within the surfaces of front and back walls 34 and 36. These slots accommodate a tool, such as a pair of long-nosed pliers 62, shown in phantom in FIG. 8. By disposing the slots longitudinally in the upper end, it is possible to accommodate the pliers without disturbing the adjacent row of terminals.

Figure 7:
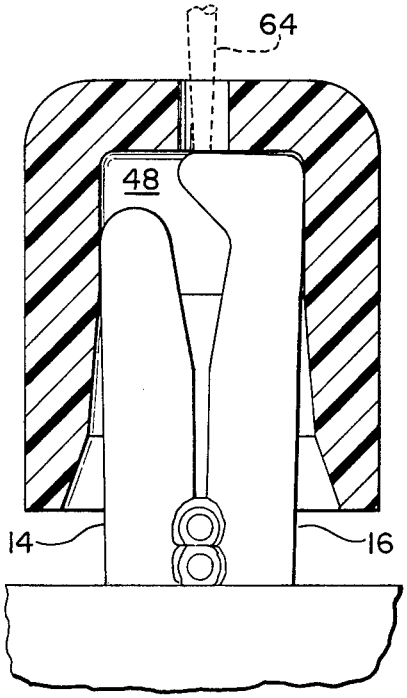
FIG. 7 is an elevational view in partial section of a terminal that has been restored to good contact with the conductors.
Figure 8:
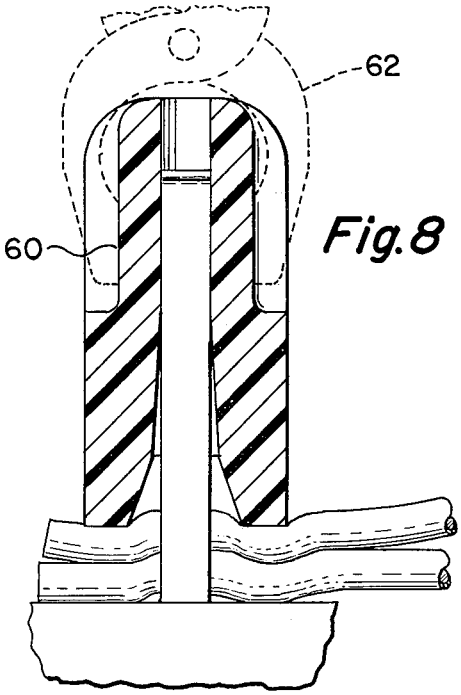
FIG. 8 is a side view in partial section showing the restoration of the terminal to its preferred position.

As was previously indicated, the aperture 50 tranverses the end wall 42 and permits a probe 64, shown in phantom in FIG. 7, to be inserted into the upper portion 48 of the bore and to contact the upper end of the terminal blade 16 for purposes of circuit testing.

Thus, a terminal cap of the type described hereinabove can be readily injection molded of any suitable dielectric thermoplastic material such as nylon.

The plastic material can be dyed in various colors to provide indicia means for identifying a particular type of circuit to which the lead-in wires 22 are connected. In this fashion an installer can readily identify a particular terminal, or row of terminals, to which it is necessary that he install a particular line or conductor to accomplish his desired result. He can test by inserting a probe 64 through the aperture 50 to insure that this is the circuit he is attempting to identify and then remove the cap 30, insert the new wire and replace the cap 30 to insure a good contact, as well as to preserve the indicia of that circuit.

I claim:

1. A one-piece dielectric terminal straightening cap adapted for use with terminals in a terminal wiring block, said cap including a one-piece body having a double tapered generally rectangular bore open through one end thereof and terminating short of the opposite end, said cap including front, back and side walls forming said bore, the said walls forming said bore being tapered for a substantial portion of their extent relative to two perpendicular planes lying on the axis of said bore, said front, back and side walls forming a wide double tapered throat having a relatively large included angle between opposite wall which blends into a lower included angle portion of said bore, said lower included angle portion having a substantially greater axial extent than said wide tapered throat and terminates in a rectangular bore having substantially parallel opposed walls for the substantial remaining portion of said bore, the transfer measurement between opposite walls of said rectangular bore being substantially equal to the corresponding complementary cross-sectional measurements of the terminal adapted to be covered by said cap, whereby a two-blade terminal that has been distorted by introduction of wires therebetween is adapted to be returned to its initial position and better contact with said wires insured.

2. A terminal cap of the type claimed in claim 1 wherein said rectangular bore is terminated at said opposite end by a transverse wall having a central aperture therein which communicates with said bore to permit introduction of a test probe to contact said terminal without removal of said cap.

3. A terminal cap of the type claimed in claim 2 wherein the exterior of said cap is provide at said opposite end with groove means to permit gripping by tool means.

4. A terminal cap of the type claimed in claim 3 wherein said groove means are longitudinally disposed on the front and back walls.

5. A terminal cap of the claimed in claim 1 wherein said cap is provided with indicia means.

* * * * *